US005801644A

United States Patent [19]

Ruthroff

[11] Patent Number: 5,801,644

[45] Date of Patent: Sep. 1, 1998

[54] APPARATUS FOR MEASUREMENT OF TORQUE ON A ROTATING SHAFT

[76] Inventor: Clyde L. Ruthroff, One Brook La., Holmdel, N.J. 07733

[21] Appl. No.: 758,908

[22] Filed: Dec. 2, 1996

Related U.S. Application Data

[63] Continuation-in-part of Ser. No. 337,852, Nov. 14, 1994.

[51] Int. Cl.[6] ..... G08C 19/06

[52] U.S. Cl. ..... 340/870.31; 340/870.28; 340/870.16; 340/870.42

[58] Field of Search ..... 340/870.01, 870.31, 340/870.28, 870.29, 870.16, 870.32, 870.4, 870.42; 455/41

[56] References Cited

U.S. PATENT DOCUMENTS

| | | | |
|---|---|---|---|
| 3,350,944 | 11/1967 | DeMichele | 340/870.16 |
| 3,657,717 | 4/1972 | Glantschnig et al. | 340/870.29 |
| 4,242,666 | 12/1980 | Reschovsky et al. | 340/870.28 |
| 4,312,001 | 1/1982 | Marzolf | 340/870.32 |
| 4,354,190 | 10/1982 | Reschovsky | 340/870.42 |
| 4,543,953 | 10/1985 | Slocum et al. | 340/870.31 |
| 4,654,573 | 3/1987 | Rough et al. | 363/18 |
| 5,142,280 | 8/1992 | Lehle | 340/870.32 |
| 5,353,020 | 10/1994 | Schurmann | 340/870.31 |

*Primary Examiner*—Jeffery Hofsass
*Assistant Examiner*—Andrew Hill
*Attorney, Agent, or Firm*—Charles I. Brodsky

[57] ABSTRACT

Apparatus for measuring the horsepower transmitted by the drive shaft of an automotive vehicle, by determining the torque on the shaft through the measurement of the resistance of an included strain gauge, yet without the need for a power supply, such as a battery, being on the rotating shaft itself.

7 Claims, 2 Drawing Sheets

FIG. 2

APPARATUS FOR MEASUREMENT OF TORQUE ON A ROTATING SHAFT (This application is a Continuation-in-Part of application Ser. No. 08/337,852, filed Nov. 14, 1994.)

FIELD OF THE INVENTION

This invention relates to automobiles, trucks and other motor vehicles, in general, and to the measurement of the horsepower being transmitted by their respective drive shafts, in particular.

BACKGROUND OF THE INVENTION

As is well known and understood, "Indianapolis-type" race car drivers and crews are very much concerned with the operation of their vehicle to provide optimum performance during the rigors of a "time-trial" or race. By being able to compare "actual" horsepower with "rated" horsepower, for example, the pit-crew can then make adjustments on the engine—to vary fuel mixtures, ignition timing, and whatever might be controllable to bring the engine to top performance. But, even to the everyday driver, an awareness of horsepower is significant, as an aid in determining when to shift gears in a manual transmission vehicle—as when driving up a hill or when passing the peak horsepower (where efficiency begins to drop off, where speed drops off, and where the horsepower decreases, as well). For the motoring enthusiast, additionally, it would be quite desirable to display on the dashboard of the vehicle—for instance—the actual horsepower being used—both for the entertainment value of providing such a "display", but also as an assist in shifting gears.

As is also well known and understood, the mechanical power transmitted through any rotating shaft is proportional to the multiplication product of the torque and the speed of the shaft, measured in revolutions per minute. Many conventional, well-known ways exist to measure the rotational speed of the shaft, without requiring any electrical source of power on the shaft itself. At the same time, conventional ways exist to measure the torque of the shaft by means of a strain gauge, whose resistance reflects the torque present. However, such measurement of the resistance of the strain gauge—in all instances—requires an electrical circuit which in turn requires power for its operation. There, then, a power supply (such as a battery) is typically installed on the rotating shaft itself. As will further be understood, such a battery periodically has to be changed and replaced, especially as its energy level is fairly low. Experience has shown that this is not just a simple and easy thing to do.

SUMMARY OF THE INVENTION

As will become clear from the following description, the apparatus of the present invention allows for these strain gauge measurements to be made, and the resultant torque determined, without the existence of a power supply—be it a battery or otherwise —on the rotating shaft. Conceptually stated, the apparatus of the invention entails transmitting electrical power from a first place A to a second place B in the direction A to B, for the purpose of powering electrical and/or mechanical equipment used in the measurement of, or operation of, equipment mounted at the second place B. Information obtained through the apparatus of the invention is then generated and transmitted back in the direction B to A, without any mechanical connection whatsoever while, at the same time, allowing a relative movement of A and B in various coordinates. With the invention, mechanical and electrical functions are then allowed to be performed on B, with information to be obtained on B, then transmitted back to A, without any source of power on B.

In a preferred embodiment of the invention to be described, a first means is included for transmitting electrical power from a first location towards a second location; second means is located at the second location, responsive to the electrical power received from the first means, for the purpose of operating a utilization apparatus; third means is then coupled to the utilization apparatus for generating a signal indicative of its performance, and for transmitting that signal back to the first means via the second means; to carry this out, the first means is stationary in operation, while the second means is mechanically rotational in operation, as where the first means includes a fixed electrical coil while the second means includes a rotating electrical coil—and in the automobile, truck and motor vehicle environment in question for measuring horsepower, the second means includes an electrical coil on a rotating mechanical shaft.

In the preferred embodiment of the invention to be described, the first means further includes an electrical power oscillator of given frequency, and where the fixed electrical coil and the rotating electrical coil are both tuned to resonate at the frequency of the oscillator. In particular, the fixed electrical coil and the rotating electrical coil are magnetically coupled to constitute a critically coupled transformer tuned to the frequency of the electrical power oscillator. With very small coupling coefficients between the coils of the critically-coupled transformer, moreover, an almost 100% efficiency of operation is attained, with the result being that a substantial change in primary current (reflecting the signalling), makes possible a remote locating of the fixed apparatus—all possible with a single pair of wires for the connection to the transformer.

Where a strain gauge is mounted on the rotating mechanical shaft and where the third means generates a signal indicative of the strain gauge at any given instant of time, a digital signal is generated, according to the invention, indicative of the resistance of the strain gauge, as utilized in determining the horsepower delivered to the wheels of the vehicle. As will become apparent to those skilled in the art, this operation is accomplished with the second means being devoid of any source of operating power and with an absence of mechanical interconnection between the first means and the second means.

In this preferred embodiment of the invention, furthermore, parallel tuning of the critically coupled transformer is employed to provide a high secondary voltage, to develop sufficient DC voltage for operating the rotating equipment. At the same time, series tuning is employed on the fixed side of the critically-coupled transformer so that the transformer can be placed at the end of a long cable, without mis-matching the impedance of the electrical power oscillator.

BRIEF DESCRIPTION OF THE DRAWINGS

These and other features of the present invention will be more clearly understood from a consideration of the following description, taken in connection with the accompanying drawings, in which.

DETAILED DESCRIPTION OF THE DRAWINGS

Figure 1B:
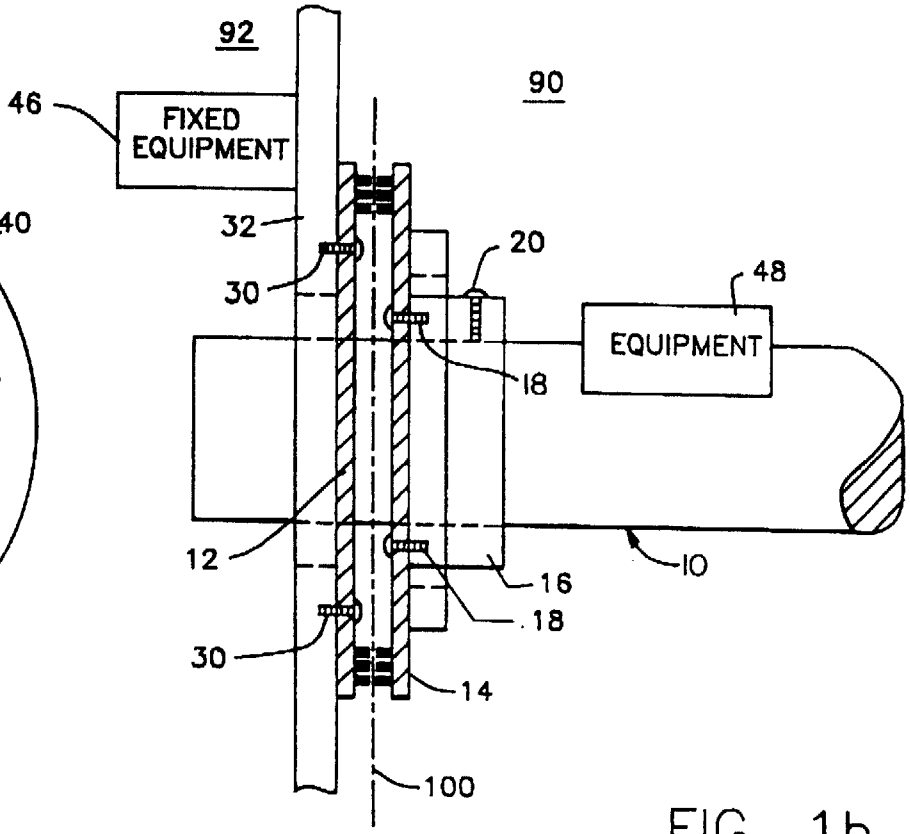
FIG. 1*a* and 1*b* are helpful in an understanding of the mounting arrangement for the apparatus of the invention as employed with the rotating drive shaft of an automobile, truck, or other motor vehicle.

FIG. 1*b* shows a rotating shaft 10 that might be turning at 2,000 rpm on which is mounted a printed circuit board 14. A mounting flange 16 attaches to the printed circuit board 14 by a pair of set screws 18, for example, and with a further set screw 20, secures the printed circuit board 14 to the rotating shaft 10. Printed onto the printed circuit board 14 is a spiral in providing an inductance—in essence then comprising a coil mounted on the rotating part of the apparatus (indicated by the reference numeral 90) secured to the shaft 10 and rotating along with it.

Figure 1A:
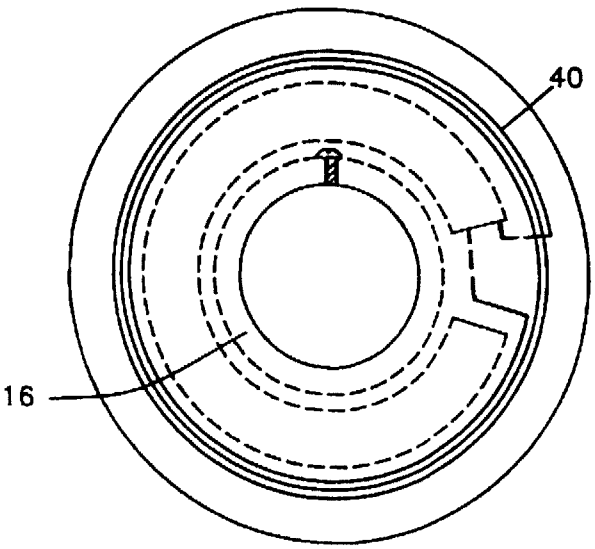

In similar manner, the printed circuit board 12 is mounted by two set-screws 30 to a stationary member of the apparatus 32 which does not rotate. Onto this printed circuit board 12, another spiral is printed, to form a second inductance facing the first one. These two coils—denoted by the letters R (for rotating) and F (for fixed)—are then magnetically coupled. The fixed part of the apparatus (indicated by the reference notation 92)—may then form a fixed, or stationary member—such as the body of the motor vehicle. As will thus be understood from this FIG. 1*b*, everything to the right of the dividing line 100 may be considered to be on the rotating shaft 10, and everything to the left of the dividing line 100 may be considered part of the motor vehicle itself. FIG. 1*a*, in the drawings, may be under-stood to be a view of the rotating coil so formed on printed circuit board 14, as seen by the fixed coil on the printed circuit board 12. The rotating spiral inductance is shown in FIG. 1*a* by the reference notation 40, with the coil 40 conceptually operating as a rotating transformer coil.

In accordance with the invention as so illustrated, then, in FIG. 1*b*, two coils are in close proximity to one another, one of which is mounted on a fixed part of the apparatus and remains stationary, while the other is mounted on the rotating part of the apparatus and rotates along with the shaft 10. Electrical power is generated in this preferred embodiment in a high frequency oscillator located within the fixed equipment 46 mounted, as shown, on the fixed part 32 of the apparatus. Such electrical power is then transmitted via the fixed coil F to the rotating coil R by means of the magnetic coupling, with the two coils F and R and associated circuitry arranged to constitute a critically coupled transformer which is tuned to the frequency of the oscillator.

The electrical components of the apparatus of the invention are mounted on the coil form R, and are connected to equipment mounted directly on the shaft 10 and shown by the reference numeral 48. Such equipment includes a strain gauge used to measure the torque of the rotating shaft. As will be appreciated, the power received via coil R through its rotation is used to power the electrical circuits in the equipment 48 which measure the resistance of the strain gauge, which code it into digital form according to the invention, and which transmit it back through the tuned transformer so created to the fixed equipment 46 for use. With the critical-coupling of the transformer, and with its primary and secondary being tuned, the resultant bandwidth of the transformer becomes narrow, with the secondary then being easily detuned during the signalling process. The result will be appreciated by those skilled in the art to be a substantial change in primary current reflecting the signalling, and makes possible remotely locating the fixed apparatus—all possible with a single pair of wires for the connection to the transformer.

In this manner, electrical power transmitted from the fixed coil F is received by the rotating coil R in the direction F to R for the purpose of powering electrical and/or mechanical equipment used in measurement or operation of the equipment mounted on the rotating shaft. Information obtained by means of the apparatus is then generated and transmitted back in the direction from R to F without any mechanical connection therebetween, while allowing relative movement of the two in a rotational manner.

Figure 2:
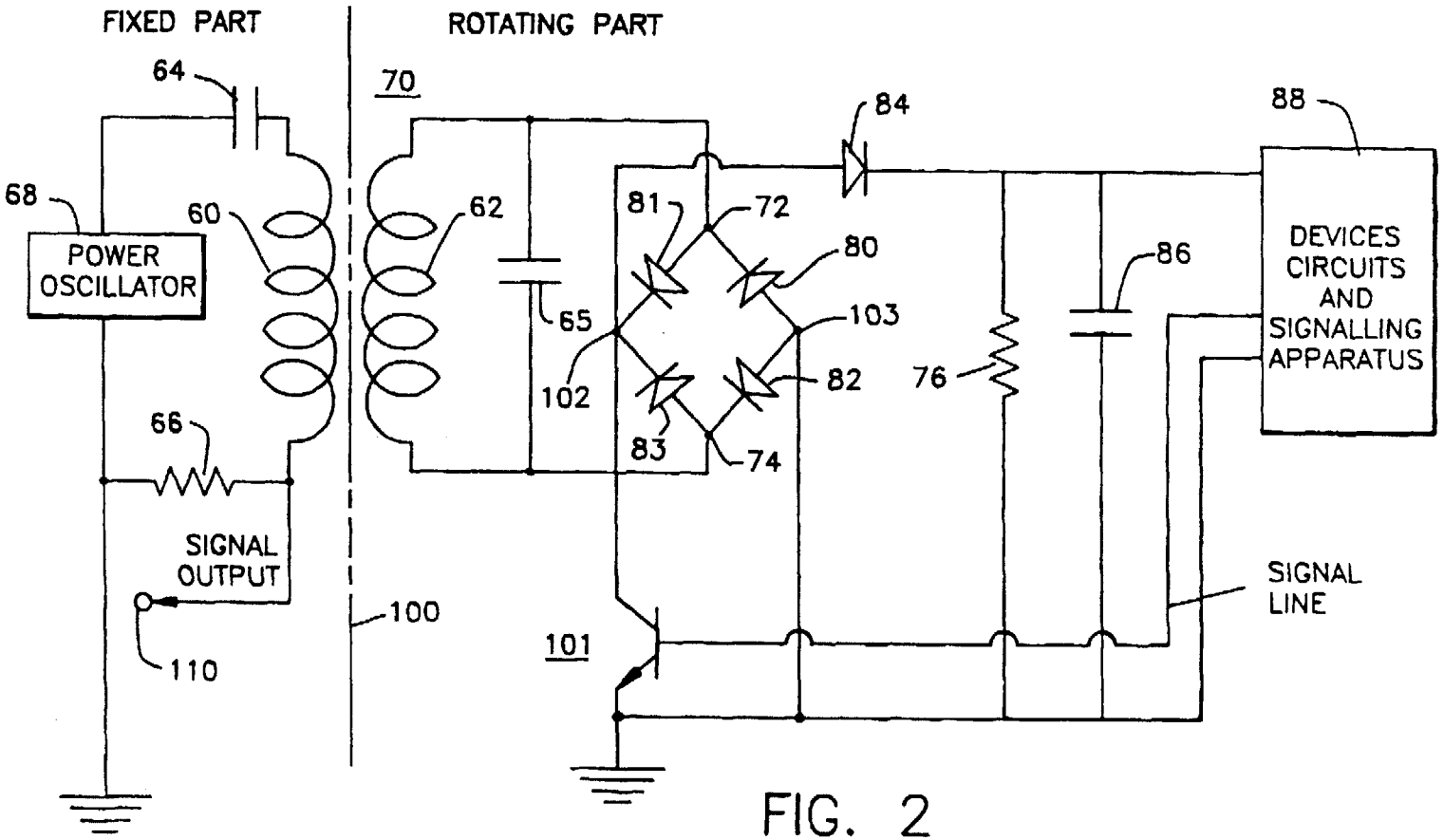
FIG. 2 is an electrical schematic diagram, partially in block form, helpful in understanding the operation of the apparatus of the invention.

FIG. 2 illustrates an electrical schematic diagram, partially in block form, of the apparatus of the invention. In particular, everything to the left of the vertical dividing line 100 is representative of the fixed part of the invention (92 in FIG. 1*a*) and everything to the right representative of the rotating part of the invention (90 in FIG. 1*b*). The stationary coil F fixed on the member 32 is shown by the notation 60 while the rotating spiral coil R secured to the shaft is shown at 62. As previously noted, the coil 60 is stationary, not free to move, while the coil 62 is able to rotate along with the shaft 10. As will be apparent, no mechanical connection exists between the two parts on either side of the dividing line 100, with the only coupling between the two being through the tuned transformer of which the coils 60, 62 form a part.

In particular, the capacitor 64, the inductor coil 60, and resistor 66 constitute the primary of a tuned, critically-coupled transformer 70, operating from a power oscillator 68 on the fixed part of the motor vehicle in block 46, and of a generally low power level to run off of the vehicle's battery. The secondary of the tuned, critically-coupled transformer 70, on the other hand, consists of the inductor coil 62, the capacitor 65 and the load impedance connected across the terminals 72, 74. Both the primary and secondary circuits of the transformer 70 are thus tuned to resonate at the frequency of the power oscillator 68, with the current flowing in the primary inductor 60 generating a magnetic field to link the secondary inductor 62 in generating a voltage in series with the inductor 62 to appear across terminals 72, 74. In this embodiment, the spacing between the two coils 60, 62 is selected so that in the absence of a further resistor 76, substantially all the available power from the oscillator 68 is coupled by the magnetic field produced to the load of the secondary connected across terminals 72, 74. The resistor 66, in series with the capacitor 64 and the primary inductor coil 60 may be of a very low value as it receives very little of the power from the oscillator 68. The value of resistor 76, on the other hand, is of a very high impedance value.

As will be appreciated, the voltage induced in the secondary coil 62 follows from there being a full-wave rectifier formed which consists of the diode bridge coupled between the terminals 72, 74, and including the components 80, 81, 82, 83. Such full-wave rectifier provides a direct current flow through a further diode 84 and the resistor 76 to produce a positive voltage across capacitor 86. As such, the energy stored in the capacitor 86 can be used to power the devices, circuits and signalling apparatus at 88 for a substantial period of time in the event the power oscillator 68 is turned off. Such diode 84 prevents current from flowing back into the rectifier bridge during such period.

As previously mentioned, conventional circuits and methods may be used to measure the resistance of a strain gauge mounted on the rotating shaft of FIG. 1*b*, code the value of the resistance into digital form, and then transmit this information back through the transformer to the fixed part of the invention. Such operation, in particular, is accomplished by means of the transistor 101 and the resistor 66.

More specifically, the digitally coded signal is transmitted back to the stationary portion of the apparatus by turning the transistor 101 ON and OFF in accordance with the input signal. Thus when transistor 101 is OFF (or non-conductive), the circuit functions as described above, wherein a current flows through the resistor 66. When transistor 101 is turned ON (i.e. conducting), on the other hand, terminals 102 and 103 essentially go to ground. Such action will be appreciated to short-circuit the secondary of the transformer so established, to result in a significant change of current through the resistor 66, in producing an output signal at the terminal 110.

Alternatively stated, the sequence of events during operation will be seen as follows: the power oscillator 68 operates and a DC voltage is developed across the capacitor 86 to operate the devices, circuits and signalling apparatus on the rotating shaft 10. Such circuits measure the resistance of the included strain gauge, code its value into digital form, and turn transistor 101 ON and OFF in accordance with the digital information. In the ON or conducting condition, transistor 101 short-circuits the transformer secondary to cause an increase in the current flow through the resistor 66. When the transistor 101 is turned OFF, the current through resistor 66 returns to its previous value, with the voltage developed across it reproducing the digitally generated signal substantially exactly, on the stationary side of the apparatus, to the left of the dividing line 100 in FIG. 2. Mechanical and electrical functions are thus able to be performed on the rotating part of the apparatus, with information obtained on the rotating member being transmitted back to the stationary section, without there being any need for having a source of power on the rotating portion. As will further be understood by those skilled in the art, with the transistor 101 conductive, little or no power is transferred from the stationary portion of the apparatus to the rotating portion. During such period, the energy stored in capacitor 86 supplies the power required to operate the devices, circuitry and signalling apparatus 88. Thus, no interruption in the operation of the circuitry there included results on the rotating section of the construction. Thus, power is transmitted from the stationary side to the rotating side, measurements are made on the rotating side for the results to be coded and transmitted back to the stationary side. No power supply is required to operate the devices, circuits and signalling apparatus in unit 88, and no mechanical connection exists between the two sides, all of which are able to be operated without any source of power on the rotating shaft, and without there then being any need to change or replace it after periods of extended use.

Various features of the invention will be appreciated to followed in this embodiment employing critically-coupled transformers. First, the parallel tuning employing the inductor coil 62, the capacitor 64 and the load impedance across the terminals 72, 74 is significant in producing a high secondary voltage, necessary in developing sufficient DC voltage for operating the rotating equipment. With the series tuning afforded by the capacitor 64, the inductor coil 60 and the resistor 66 on the stationary side, on the other hand, the transformer can then be placed at the end of a long cable, without mismatching the impedance of the power oscillator 68. Second, with the high, almost 100% efficiency of the critically coupled transformer, minimum power need be generated in the power oscillator 68, which permits the use of low-voltage integrated circuits—in the oscillator 68—allowing it to operate at correspondingly low temperatures to prolong the life of the equipment. Where operating temperatures are hitch (for example, in military equipment), this feature is especially important. Third, and as will be understood, in different applications of the invention, different spacings may be required between the fixed coil and the rotating coil. On an automobile axle, for example, the region between the fixed and rotating parts is oftentimes subject to the accumulations of mud, debris and ice. With the critically-coupled tuned transformer of the invention, on the other hand, the transformer can be designed for the specific distance between the fixed and rotary coils, as required. With the critically-coupled transformer, designs could be had for specific separations over a relatively wide range of spacings, as the magnetic couplings necessary for critical coupling are very low—for example with a coupling coefficient of as little as 0.001.

Additionally, many uses of the apparatus of the invention employ the primary, fixed and secondary, rotating coils wound around a large steel shaft—frequently with one or more steel bearings in the vicinity of the coils. Analysis has shown that the shaft and the bearings themselves constitute shorted-turns which can consume large amounts of power, and seriously impair or render ineffective the operation of many transformers. However, and as described above, the coupling between the coils of a critically-coupled transformer as employed in the present invention is very small, while the efficiency continues at almost 100%. The coupling to the steel shaft and the steel bearings with the invention will also be seen to be very small, to render any loss due to shorted-turns completely negligible. Similarly, any metal debris forming between the fixed and rotary coils will be seen to have a negligible effect on the operation of the critically-coupled transformer employed.

Also, in the operation of the invention in measuring torque on a rotating shaft, the information transferred from the rotary side to the stationary, fixed side by short-circuiting the rotary coil reflects an impedance change to the stationary side, and changes the current in the primary coil 60 and in the resistor 66. As will be realized, the magnitude of the change in the current through resistor 66 depends upon the efficiency of the transformer, and because of the high efficiency of the critically-coupled transformer here employed, produces a correspondingly large change. This is to be contrasted with a situation employing a "lossy" transformer, which masks the change in current, and increases the probability of errors in transmission.

As will also be seen, a critically-coupled transformer, as one of its characteristics, exhibits the narrowest bandwidth. In many, if not most, applications in measuring torque in a motor vehicle environment, the equipment of the invention is to be operated in the vicinity of spark plugs, which emit a high level of broadband electrical noise—of an extent which can render sensitive measurements impossible, including the resistance measurements of strain gauges. With the narrow bandwidth of the critically-coupled transformer of the invention, on the other hand, this electrical noise is reduced to its minimum value, to afford the greatest protection against errors caused by the broadband noise.

Moreover, the currents generated in the rotating coil 62 by the power oscillator 68 generate powerful magnetic fields in the integrated circuits employed on the rotating part of the apparatus. Such fields generate large, undesirable currents in the integrated circuits due to Hall Effect. As are recognized, such currents are frequently large enough to render the sensitive strain gauge measurement useless, unless circuitry is moved well away from the transformed coil to reduce the current to acceptable values. In apparatus measuring torque on the rotating shaft of a motor vehicle, however, this is not easily done, because of the restricted space available for the total placement of the apparatus. With the invention, as described above, the sensitive measurements are made when the oscillator power is turned off, making the measurements still possible as the capacitor 86 maintains the DC supply voltage on the rotary side while the measurement is being made. In one construction, with the values set forth below, the oscillator power is turned off for one millisecond—during which time the strain gauge is measured. When the measurement is securely stored then in digital format, the power goes back on and the rest of the signal processing continues.

While applicant does not wish to be limited to any particular set of component values, the following have proved useful in a construction of the preferred embodiment:

| | |
|---|---|
| Power required for rotary apparatus | 10 milliwatts |
| Frequency | 2 MHz |
| Inductive Coil 60 | 26 microhenries |
| Inductive Coil 61 | 26 microhenries |
| Capacitor 64 | 240 picofarads |
| Capacitor 65 | 240 picofarads |
| Capacitor 86 | 10 microfarads |
| Resistor 76 | 1,000 ohms |
| Resistor 66 | 10 ohms |

With such an embodiment, and with the component values set forth, approximately 10 volts is generated across capacitor 86 for its operation.

While there has been described what is considered to be a preferred embodiment of the present invention, it will be readily appreciated by those skilled in the art that modifications can be made without departing from the scope of the teachings herein. For at least such reason, therefore, resort should be had to the claims appended hereto for a true understanding of the scope of the invention.

I claim:

1. A combination comprising:

utilization apparatus;

first means, including an electrical power oscillator, for transmitting electrical power from a first location towards a second location;

second means, at said second location, responsive to electrical power received from said first means, for operating said utilization apparatus;

third means coupled to said utilization apparatus for generating a signal indicative of performance thereat, and for transmitting said signal to said first means via said second means;

with said first means being stationary in operation, and with said second means being mechanically rotational in operation;

with said second means being devoid of any source of operating power thereon; and with there being an absence of mechanical interconnection between said first means and said second means;

wherein said first means also includes a fixed electrical coil;

wherein said second means includes an electrical coil on a rotating mechanical shaft; and wherein said fixed electrical coil and said rotating electrical coil are both tuned to form a critically-coupled transformer resonating at the frequency of said oscillator.

2. The combination of claim 1 wherein said fixed electrical coil is incorporated in a primary winding of said critically-coupled transformer, in series tuning therewith.

3. The combination of claim 1 wherein said electrical coil on said rotating mechanical shaft is incorporated in a secondary winding of said critically-coupled transformer, in parallel tuning therewith.

4. The combination of claim 1 wherein said fixed electrical coil is incorporated in a primary winding of said critically-coupled transformer, in series tuning therewith, and wherein said electrical coil on said rotating mechanical shaft is incorporated in a secondary winding of said critically-coupled transformer, in parallel tuning therewith.

5. The combination of claim 1 wherein there is also included a strain gauge mounted on said rotating mechanical shaft, and wherein said third means generates a signal indicative of the resistance of said strain gauge at any given instant of time.

6. The combination of claim 5 wherein said third means generates a digital signal indicative of said resistance of said strain gauge.

7. The combination of claim 6 wherein said utilization apparatus includes the wheels of an automotive vehicle.

* * * * *